United States Patent [19]

Irwin

[11] Patent Number: 4,554,937

[45] Date of Patent: Nov. 26, 1985

[54] PORTABLE SHELTER

[76] Inventor: Dennis V. Irwin, 4630 Macky Way, Boulder, Colo. 80303

[21] Appl. No.: 472,029

[22] Filed: Mar. 4, 1983

[51] Int. Cl.[4] ..... A45F 1/16

[52] U.S. Cl. ..... 135/100; 135/109

[58] Field of Search ..... 135/100, 109, 110–113, 135/901, 117, 87, 119, 115; 272/113; 160/135; 47/29

[56] References Cited

U.S. PATENT DOCUMENTS

| | | | |
|---|---|---|---|
| 1,392,178 | 9/1921 | Kuebler | 47/29 |
| 2,755,009 | 7/1956 | Parker | 135/100 |
| 2,967,534 | 1/1961 | Silye | 135/901 |
| 3,503,101 | 3/1970 | Kolozsvary | 135/119 |
| 3,913,598 | 10/1975 | Glutting et al. | 135/117 |
| 4,097,169 | 6/1978 | Kelly | 135/119 |
| 4,159,112 | 6/1979 | O'Brian et al. | 272/113 |

*Primary Examiner*—Richard J. Apley
*Assistant Examiner*—S. R. Crow
*Attorney, Agent, or Firm*—James E. Pittenger

[57] ABSTRACT

A portable, free-standing shelter for hunters and the like is of generally frusto-conical configuration and has a base and upwardly inclined sidewalls terminating in an open top. The sidewalls are defined by a plurality of panels of generally triangular or trapezoidal configuration, having top and bottom edges connected by upwardly convergent opposite sides. Hinged connecting means interconnect adjacent sides of the panels in articulated relation so that the bottom edges of the panels define the base of the shelter and the top edges of the panels define the open top thereof. The connected panels may then be arranged into various configurations, including a substantially open shelter or screen, or a closed or partially closed shelter as desired.

13 Claims, 5 Drawing Figures

PORTABLE SHELTER

This invention generally relates to portable shelters, and more particularly relates to a novel and improved collapsible portable shelter which is particularly suitable for, but not limited to, use by hunters and other outdoorsmen as a blind or concealing screen and by utility workers as a shelter or safety cover.

BACKGROUND AND FIELD OF THE INVENTION

Hunters, birdwatchers or wildlife photographers pursuing certain types of game, such as, waterfowl often experience greater success by setting up a temporary "camp" and waiting for the animal to approach within range than by actively stalking their quarry. In practicing the former technique, the outdoorsman first selects a spot that is likely to be frequented by the animal, then conceals his presence there by some means, and finally settles down to wait, perhaps for hours, for the arrival of his quarry. In the past, the choice of a likely spot has been subject to the availability of natural shelter, such as, a thicket to serve as a screen. Unfortunately, such means of concealment are not always available at an otherwise favorable site. Moreover, bushes and the like do not afford much protection from the elements, and therefore are likely to become an uncomfortable shelter after any length of time.

Alternatively, the outdoorsman may resort to using an artificial shelter of the type known commonly as a "duck blind" which comprises a low, shack-like structure constructed of plywood or similar material provided with a burlap screen or small windows for observation of the hunting site. Such blinds serve as permanent shelters and are most often built along the shores of frequently hunted lakes and reservoirs and are therefore unsuitable for the outdoorsman who wishes to avoid the more popular areas, or who prefers to move from site to site in search of the most favorable location for his purposes. To date, there remains a need for a temporary shelter or blind which is capable of being constructed and taken down quickly, and may be moved easily to different locations while still fully assembled, or with only minimal disassembly. Moreover, it is particularly desirable that such structure be adaptable for a variety of other uses, for example, as a windbreak or emergency tent, or as a storage structure for firewood, food, or other supplies. The portable shelter of the present invention is believed to offer these as well as other advantages which will be particularly valuable to hunters, fishermen, photographers, or anyone requiring a temporary shelter or camouflage device for any purpose.

SUMMARY OF THE INVENTION

It is therefore an object of the present invention to provide for a novel and improved free-standing portable shelter or blind particularly suitable for use by hunters and other outdoorsmen as a means of concealment or as a windbreak, and additionally as a tent or storage structure.

Another object of the present invention is to provide for a novel and improved portable shelter or blind which is adapted for rapid assembly into a free-standing, closed structure either with or without a cover or roof portion, or alternatively into an open, generally linear configuration so as to form a screen, or into a partially closed arrangement provided with a door or accessway.

It is a further object of the present invention to provide for a novel and improved portable shelter which may be folded into a compact unit for convenient transport.

It is a still further object of the present invention to provide a portable shelter or blind which is constructed of lightweight materials and may be assembled without the use of tools or separate fastener means, such as, bolts or brackets.

Yet another object of the present invention is to provide a portable blind or shelter which includes releasable connector means to effect interconnection and disengagement of panel or wall portions and frame members.

It is a further object of the present invention to provide a portable structure which can be adapted to assume different configurations for a variety of uses merely by selecting and interconnecting the desired number of wall portions, and which further includes a roof or cover portion which may be removably attached to the structure when a closed shelter is required.

In accordance with the present invention, there has been devised a preferred form of portable, free-standing shelter of generally frusto-conical configuration having a base and upwardly inclined sidewalls terminating in an open top. The sidewalls are defined by a plurality of panel members of generally polygonal configuration, having top and bottom edges interconnected by upwardly convergent opposite sides. Connecting means interconnect adjoining sides of the panel members in hinged-together relation so that the bottom edges of the panel members define the base of the shelter and the top edges of the panel members define the open top of the shelter. A form of portable shelter is comprised of a plurality of generally trapezoidal frame members and generally trapezoidal panel members which span the frame members and are held in a stretched, taut condition and include means for connecting the panel members in side-by-side relation to each other so as to form a free-standing shelter structure. The panel members and frame members are arranged so that side edges of adjacent panels connected or are overlap and surround adjacent side sections of adjacent frame members within said overlapping portion, and the panels are fastened together with the overlapping portions to retain the side sections of the frame members therein and thereby connect adjacent frame members in juxtaposed relation to one another. The overlapping portions further include integral hinge members to enable pivotal movement of the frame members with respect to each other and allow adjustment of the shelter into different configurations. The panel portions further include releasable fastening means along their upper and lower edges adapted to engage respective upper and lower sections of the trapezoidal frame members.

An optional removable roof or cover portion may be placed over the upper opening formed in the assembled structure which comprises a polygonal panel dimensioned to generally correspond with and close said upper opening, intersecting supporting crossbars disposed beneath the roof panel, and means for releasably securing the roof structure to the portable shelter.

The above and other objects, advantages and features of the present invention will become more readily appreciated and understood when taken together with the following detailed description of a preferred embodiment of the present invention in conjunction with the accompanying drawings, in which:

DETAILED DESCRIPTION OF THE PREFERRED EMBODIMENT

Figure 1:
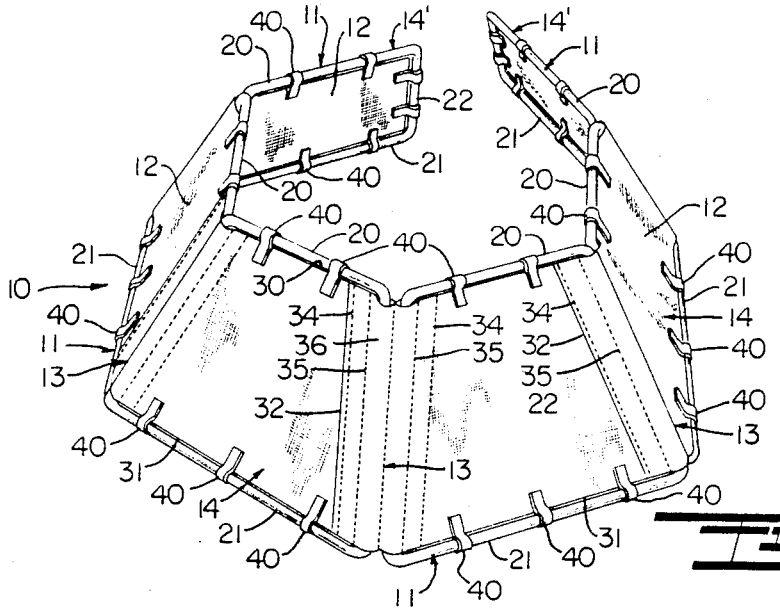
FIG. 1 is an isometric view of the portable shelter in accordance with the present invention, illustrating a substantially closed shelter wherein one sidewall is employed as an accessway.

Referring in more detail to the drawings, and particularly to FIG. 1, the preferred form of portable shelter 10 is illustrated by way of example as a six-sided structure wherein a plurality of generally trapezoidal tubular frame members 11 are connected in side-by-side relation by means of a plurality of flexible fabric sheet portions 12 secured to frame members 11 and forming articulated connector portions 13 therebetween. The resulting structure of linked panels 14 may then be arranged into a closed or partially closed shelter.

The frame members 11 are symmetrically formed and preferably are trapezoidal having parallel upper and lower frame segments 20, 21 joined to non-parallel upwardly converging side segments 22 by slightly rounded corner portions 23. Each side segment 22 is disposed in fixed angled relation to an upper and a lower segment 20, 21 so as to form an obtuse angle of approximately 120° with respect to upper segment 20 and an acute angle of approximately 60° with respect to lower segment 21. It will be understood that the precise angulation may be varied depending upon the number of walls, desired height of the assembled shelter and the desired inward inclination of the walls; nonetheless, the angles formed with respect to the upper and lower frame segments 20, 21 must be supplementary, with the lower angle preferably less than 90°. Frame members 11 may also be constructed from a number of identical, generally C-shaped portions which are joined into a trapezoidal configuration by uniting upper and lower free ends of each portion by means of tightly fitting sleeve connectors or the like.

Figure 2:
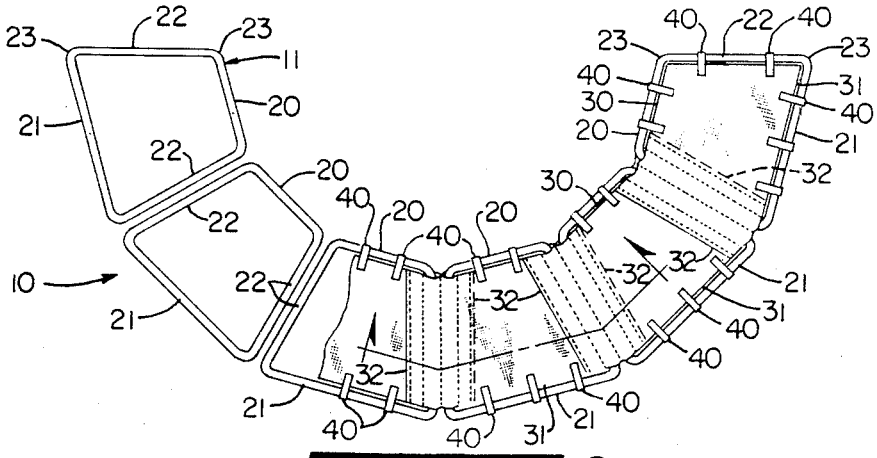
FIG. 2 is a top plan view of the portable shelter of FIG. 1 in an expanded position, with panel portions partially broken away to illustrate the frame members.
Figure 3:
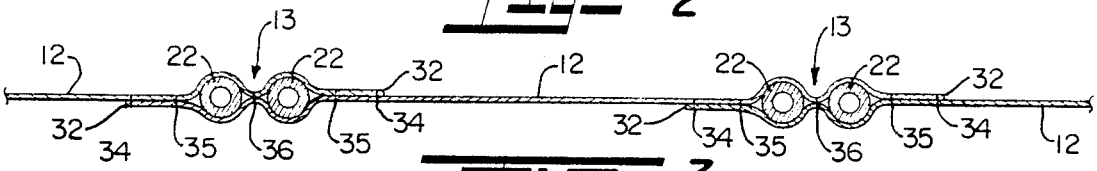
FIG. 3 is an enlarged cross-sectional view taken along lines 3—3 of FIG. 2.

Fabric sheet portions 12 are correspondingly symmetrical and therefore trapezoidal, but are somewhat shorter and wider than frame members 11 so that when a sheet 12 is superimposed upon a frame member 11, its upper and lower edges 30, 31 terminate slightly to the inside of upper and lower frame segments 20, 21 and side edges 32 extend beyond side frame segments 22. In order to connect the frame sections in articulated relation, the connector means 13 operate to secure the frame members 11 to the fabric sheets 12 in forming the panels 14 of the shelter 10, said connector means 13 preferably comprising continuations of the sheet portions which overlap and permit connection of the frame members 11 in side-by-side relation to one another and at the same time act as hinges to permit pivotal or swinging movement of the frame members 11 with respect to each other. Referring to FIGS. 2 and 3, one side edge 32 of a sheet 12 is positioned to extend behind one side segment 22 of a first frame member 11 and an adjacent side segment 22 of a second frame member 11, terminating slightly beyond the side segment 22 of the second frame member 11. The opposite side edge 32 is positioned to extend in front of the opposite side segment 22 of first frame member 11 and an adjacent side segment 22 of a third adjacent frame member 11. Remaining fabric sheets 12 are arranged in a like manner, so that one side edge 32 overlaps adjacent side frame segments 22 and the opposite side edge 32 underlies adjacent side frame segments 22. The sheets 12 are then stitched along side edges 32 from upper edge 30 to lower edge 31, as represented at 34. Further, stitching is employed along the inside of side frame segments 22, as at 5, and between adjacent frame members 11, as at 36. In this manner, a plurality of frame members 11 may be connected in side-by-side relation to form walls or panel members 14 as illustrated in FIG. 2.

Figure 4:
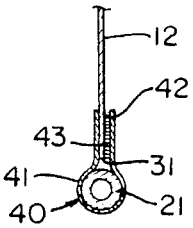
FIG. 4 is an enlarged vertical cross-sectional view of the lower portion of a shelter wall, illustrating the fastening means for securing panel portions to frame members.

It will be appreciated that the side frame segments 22 are securely retained between the overlapping connector portions 13 of the sheets 12, and that the stitching 36 between adjacent frame members 11 defines a hinge which permits a wide degree of flexing so that the angled relation between the shelter wall panels 14 may be adjusted over a considerable range. In this relation, adjoining segments 22 of terminal end panels 14' are left unconnected by folding the sheet edges 32 around the segments 22 and securing in the same manner as hereinafter described with respect to FIG. 4. It will be seen that one end panel 14' may be utilized as a door or gate to the shelter as shown, or the end panels 14' may be fastened along their adjacent abutting side frame segments 22 in order to produce a closed hexagonal shelter. Referring to FIG. 2, the structure may be spread out on the ground into a substantially flat arrangement, whereupon panels 14, 14' can be folded accordion-style at the hinge lines formed by the stitching 36 until the entire structure is folded into a compact unit for convenient carrying and storage. Naturally, many structural variations can be effected between the raised, substantially closed arrangement of FIG. 1 and the collapsed position of FIG. 2, merely by adjusting the angled relation of the walls to each other, and by removing or adding panels 14.

Upper and lower edges 30, 31 of the fabric sheets 12 are releasably fastened to upper and lower frame segments 20, 21 by appropriate means, preferably comprising hook-and-thistle type fasteners 40, commonly sold under the trademark "Velcro" ®. A lower edge fastener 40 is illustrated in detail in FIG. 4 and includes a tab portion 41, stitched at one end or otherwise secured to one side of a fabric sheet 12 and provided at the other end with a strip or patch of hook material 42. A corresponding strip of thistle material 43 is fastened in a corresponding position on the opposite side of fabric sheet 12. Tab 41 is passed under lower frame segment 21 and pulled upwardly until hook strip 42 is aligned with thistle strip 43; hook strip 42 is then pressed into engagement with thistle strip 43. Identical fasteners are employed along the free sides of the end walls and the upper edges 30 of sheets 12; however, in the latter case tab portions 41 are passed over upper frame segments 20 in order to effect engagement between hook and thistle strips 42, 43. It will be understood that other types of fastening means, such as, snaps may be applied to tabs 41 and fabric sheets 12; or further that upper and lower sheet edges 30, 31 may be provided with grommets and ties at spaced intervals.

Figure 5:
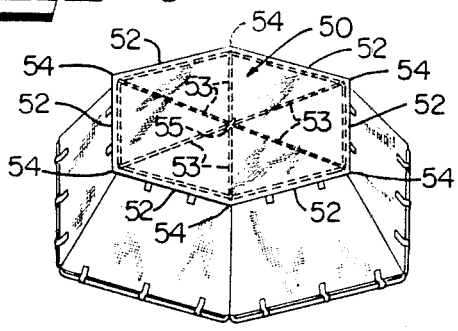
FIG. 5 is an isometric view of the portable shelter of FIG. 1 with a removable cover structure disposed thereon.

FIG. 5 illustrates the use of the shelter 10 with an optional removable roof or cover 50, which may be particularly useful in case of bad weather, or if it should become necessary to use the structure as an emergency tent or as a shelter for firewood, food or other supplies. Roof 50 preferably comprises a polygonal fabric sheet or panel 51 having six side edges 52. Panel 51 is slightly larger in area than the upper opening of the shelter 10 formed by the assembled wall panels 14 so that side edges 52 overlap upper frame segments 20 slightly. The roof panel 51 may be fastened along the upper edges 30 of sheets 12 by Velcro closures, which may comprise a single, continuous closure providing sealing engagement around the perimeter of roof panel 51 and upper sheet edges 30. Preferably, a substantially continuous strip of thistle material is applied to the underside of the roof edges 52, and a strip of hook material is applied along the upper edges 30 of the sheets 12. The above-described Velcro fasteners 40 disposed along the upper edges 30 of fabric sheets 12 could be employed in securing the roof as well by enlarging thistle strips 43 so that a portion thereof extends below the end of the strap 41 fastened thereto. Aligned strips of hook material applied to the underside of the roof edges may then be pressed into engagement with the extended portions of the thistle strips. Alternatively, the closure means could include a plurality of hook-and-thistle fasteners applied at corners and spaced intervals therebetween. It is, of course, contemplated that the roof panel 51 may be fastened to the shelter by other suitable means, such as, by a plurality of snaps, or by grommets and ties. The removable roof structure 50 further includes underlying, intersecting crossbars 53 which extend between opposite corners 54 of the shelter 10 so as to support the roof panel 51. The crossbars 53 are held together and stabilized at their point of intersection by an elastic annular member or O-ring 55, which also serves to hold crossbars 53 together in parallel, close-fitting relation when the roof structure 50 is dismantled. Alternatively, the crossbars 53 could be positively but releasably attached to the underside of roof panel 51 by any suitable means.

Operation and assembly of the portable shelter have been described in the foregoing disclosure of the preferred embodiment, and the suggested variations should be obvious to one skilled in the art. Any appropriate materials may be employed in the manufacture of the shelter; however, it is desirable that the materials be lightweight, yet durable, as befits the intended use of the invention by outdoorsmen. For example, frame members 11 may be fabricated from aluminum, fiberglass or plastic tubing, and fabric sheets forming the walls and roof may be nylon, canvas, or similar durable water-repellant fabric. It will be further evident that windows or zippered openings may be formed at selected intervals in the fabric covering; also, the number, size and specific configuration of wall sections may be varied over a wide range.

It is therefore to be understood from the foregoing that various modifications and changes may be made in the construction and arrangement of parts as well as their method of fabrication without departing from the spirit and scope of the present invention as defined by the appended claims.

I claim:

1. A portable, free-standing shelter of generally frusto-conical configuration having a base and upwardly inclined sidewalls terminating in an open top, said sidewalls defined by a plurality of flexible sheet panel members, each panel member of generally polygonal configuration having top and bottom edges interconnected by upwardly convergent opposite sides; connecting means interconnecting adjoining sides of said panel members in hinged together relation, the bottom edges of said panel members defining the base of said shelter and the top edges of said panel members defining the open top of said shelter; a plurality of frame members to hold said flexible sheet panel members in a stretched, taut condition, each of said frame members being formed in a trapezoidal configuration and each of said panel members includes a releasable fastening means for releasably securing each of said panel members to the top and bottom edges of its respective frame member.

2. A portable, free-standing shelter according to claim 1, wherein said frame member is an open frame.

3. A portable, free-standing shelter according to claim 2, each of said panel members terminating in said connecting means at adjoining sides between said panel members.

4. A portable, free-standing shelter according to claim 1, including a removable cover portion traversing the open top of said shelter.

5. A portable, free-standing shelter according to claim 1, wherein said panel members are adapted to be folded accordion-style at said connecting means into superimposed panel members.

6. A portable, free-standing shelter of generally frusto-conical configuration having a base with an upwardly inclined sidewall terminating in an open top portion, said sidewall defined by a plurality of trapezoidal flexible sheet panel members, each panel member having a frame member and defining a bottom edge, top edge and upwardly convergent sides, said frame member being arranged to hold said flexible panel members in stretched, taut condition, hinge-like connecting means between adjoining sidewalls of adjacent panel members for securing said panel members in hinged-together relation at circumferentially spaced intervals around said shelter, and said hinge-like connecting means each defining a unitary extension of said sheet members and disposed in overlapping relation to adjoining sides.

7. In a portable, free-standing shelter according to claim 6, which further includes securing means for securing together said overlapping unitary extensions along spaced parallel lines so as to surround and separate the adjacent sides of said frame members.

8. In a portable, free-standing shelter according to claim 6, said first releasable fastening means comprising a plurality of strap members, each affixed at one end to one side of one said sheet member at spaced intervals along said top and bottom edges, the opposite ends of said strap members each provided with a portion of hook material which is releasably engageable with an aligned thistle portion affixed to the opposite end of said sheet member upon wrapping said strap member around either of said top or bottom edges of said frame member.

9. In a portable, free-standing shelter according to claim 6, including a removable cover portion traversing the open top portion of said shelter.

10. In a portable, free-standing shelter according to claim 9, said removable cover portion including second releasable fastening means releasably engageable with said top edges of said panel members.

11. In a portable, free-standing shelter according to claim 10, said second releasable fastening means comprising aligned hook-and-thistle fasteners arranged at spaced intervals along the peripheral edges of said roof portion and said top panel edges.

12. In a portable, free-standing shelter according to claim 11, said hook portion of each said second hook-and-thistle fastener being attached to the underside of said peripheral edge of said roof portion, and the thistle portion of said second fastener comprising an elongated portion extending downwardly from said thistle portion of said first releasable fastening means and beyond said strap members engaged therewith, said elongated portion adapted to receive said hook portions on said roof edge in releasable engagement therewith.

13. A portable, free-standing shelter of generally frusto-conical configuration having a base and upwardly inclined sidewalls terminating in an open top, said sidewalls defined by a plurality of flexible sheet panel members, each panel member of generally polygonal configuration having top and bottom edges interconnected by upwardly convergent opposite sides; connecting means interconnecting adjoining sides of said panel members in hinged together relation, the bottom edges of said panel members defining the base of said shelter and the top edges of said panel members defining the open top of said shelter; each of said panel members defined by an open frame member of generally trapezoidal configuration; and each of said flexible sheets terminating in said connecting means which defines a unitary extension of each of said sheet members.

* * * * *